United States Patent [19]

Johnson, Jr.

[11] 3,955,467

[45] May 11, 1976

[54] UNI-DIRECTIONAL ROPE

[76] Inventor: Edwin W. Johnson, Jr., 2551 Green Castle Court, Oxnard, Calif. 93030

[22] Filed: Nov. 25, 1974

[21] Appl. No.: 526,902

[52] U.S. Cl. ..... 87/7; 57/144; 428/377

[51] Int. Cl.[2] ..... D04C 1/12

[58] Field of Search ..... 87/5–8; 57/144, 145; 428/375, 377

[56] References Cited

UNITED STATES PATENTS

| | | | |
|---|---|---|---|
| 1,771,912 | 7/1930 | Blaisdell | 87/7 X |
| 2,076,667 | 4/1937 | Pombo | 87/6 X |
| 3,338,129 | 8/1967 | Mitchell et al. | 87/7 |
| 3,565,127 | 2/1971 | Nicely et al. | 87/6 X |

*Primary Examiner*—John Petrakes
*Attorney, Agent, or Firm*—Ralph B. Pastoriza

[57] ABSTRACT

A rope is formed by using at least four warps running parallel to each other and positioned such that when viewed in cross section, their centers fall on the corners of a square. These parallel warps are held together by bobbin threads passing about diagonally opposite warps. The parallel warps result in minimum elongation of the rope when under tension.

1 Claim, 4 Drawing Figures

PRIOR ART

UNI-DIRECTIONAL ROPE

This invention relates generally to ropes and more particularly to an improved rope structure resulting in longer wear and greater tensile strength than coventional ropes of the same mass per unit length.

BACKGROUND OF THE INVENTION

Conventional rope is normally made up of strands or warps which are twisted or braided together. As a consequence, when the rope is under tension, it tends to elongate since the warps are biased under such tension towards an untwisted position. Aside from the tendency to elongate which in certain circumstances may be undesirable, the biasing of the warps towards an untwisted condition causes wear from rubbing action of the warps against each other. Finally the same untwisting bias when the warps are under tension will result in any load secured to the rope tending to rotate.

Some of the foregoing problems have been solved by providing straight parallel warps enclosed within a sheathing. In other words, a core portion of the rope is made up of parallel strands or warps. While elongation under tension is minimized with these proposed constructions, there is a tendency for this sheathing or outer covering to slip relative to the core. In addition, the various warps making up the core can slide relatively to each other in a longitudinal direction. Finally, the manufacture of such types of rope with parallel strand cores is relatively more expensive than conventional rope in that the braided sheath or covering must be provided.

BRIEF DESCRIPTION OF THE PRESENT INVENTION

With the foregoing in mind, the present invention contemplates an improved rope construction wherein the advantages of parallel warps or strands is realized without the necessity of providing an outer sheath or covering.

More particularly, in accord with the invention there are provided at least four warps or strands running parallel to each other and positioned such that when viewed in cross section their centers fall on the corners of a square. Bobbin thread is passed about diagonally opposite warps, the thread about one diagonally opposite pair of warps passing between the warps of the other diagonally opposite pair, and thread about said other diagonally opposite pair passing between said one diagonally opposite pair of warps.

In a preferred embodiment, there is provided a fifth warp passing centrally of the other four warps in parallel relationship such that its center coincides with the geometric center of the referred to square. The portions of the bobbin thread passing between diagonally opposite warps binds the outer four warps to this fifth warp so that there is no relative slippage between the warps in a longitudinal direction.

BRIEF DESCRIPTION OF THE DRAWINGS

A better understanding of the invention will be had by now referring to the accompanying drawings in which.

DETAILED DESCRIPTION OF THE PREFERRED EMBODIMENT

Figure 1:
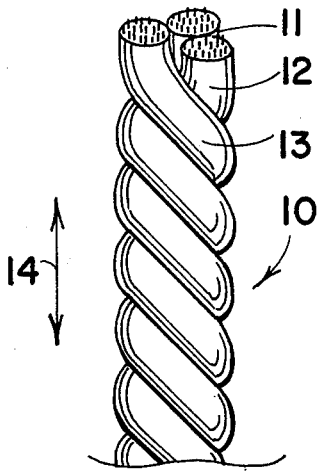
FIG. 1 is a perspective view of a typical prior art rope construction.

Referring first to FIG. 1 there is shown a conventional rope 10 made up of strands or warps 11, 12 and 13. These warps are twisted together in a spiral manner as shown.

With the foregoing construction, it will be evident that when the rope 10 is under tension as indicated by the double headed arrow 14, the warps will tend to untwist resulting in an elongation of the rope. Moreover, the relative movement between the warps under tension results in wear and thus limits the useful life of the rope.

Figure 2:
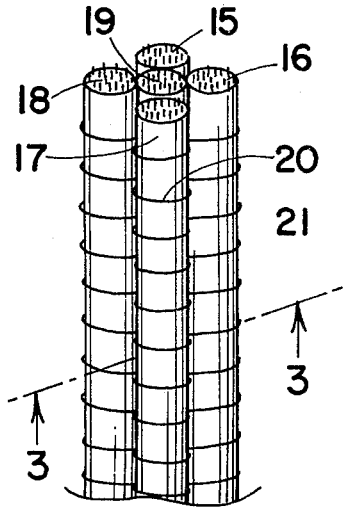
FIG. 2 is a perspective view of the improved rope of the present invention.

Referring now to FIG. 2, there is shown in contrast to FIG. 1, the improved rope of the present invention. This rope is made up of at least four and preferably five warps indicated at 15, 16, 17, 18 and 19. The warps all run parallel to each other and are secured together by bobbin threads as indicated at 20 and 21.

Figure 3:
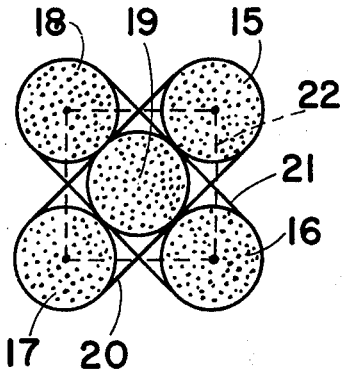
FIG. 3 is a cross section taken in the direction of the arrows 3-3 of FIG. 2.

With particular reference to the cross section of FIG. 3, it will be noted that the four warps 15, 16, 17 and 18 are positioned such that their centers fall on the corners of a square indicated in dashed lines at 22. The bobbin thread 20 is shown passing about one pair of diagonally opposite warps such as 15 and 17 while the bobbin thread 21 is shown passing about the other pair of diagonally opposite warps 16 and 18.

The fifth warp 19 passes centrally of the four warps in parallel relationship such that its center coincides with the geometric center of the square 22.

Figure 4:
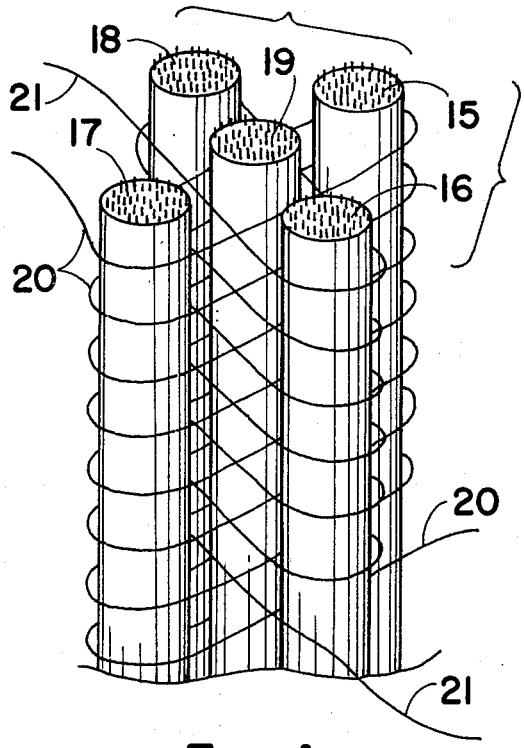
FIG. 4 is an enlarged exploded perspective view of the rope of FIG. 2 useful in explaining further details of the rope structure.

Referring to the more detailed, exploded perspective view of FIG. 4, it will be seen that the bobbin thread 20 passing about the one diagonally opposite pair of warps 15 and 17 passes between the other diagonally opposite warps 16 and 18. Similarly, the bobbin thread 21 passing about the other diagonally opposite pair of warps 16 and 18 passes between the one diagonally opposite pair of warps 15 and 17.

The application of the bobbin thread, sometimes referred to as pick, can be carried out by a conventional bobbin carrier braid machine suitably modified.

Because the bobbin thread 20 about the diagonally opposite pair 15 and 17 passes between the other diagonally opposite pair 16 and 18, and the bobbin thread 21 about the pair 16 and 18 passes between the diagonally opposite pair 15 and 17, the four outer warps are bound to the fifth central warp. When the bobbin thread is drawn tightly, the overall configuration is fairly circular. In the event the central or fifth warp were omitted, the overall configuration would more approach a square.

It will be appreciated that as a consequence of the parallel warps, substantially no elongation will take place under tension. Moreover, there will be no relative rubbing motion between the warps which are all bound tightly together by the bobbin thread and no tendency for a load carried by the rope to rotate. Finally, under appropriate tests, the improved rope construction results in a stronger rope capable of carrying a substantially greater load than an equivalent twisted type prior art rope of the same mass per unit length.

What is claimed is:

1. A uni-directional rope comprising, in combination:

a. four warps running parallel to each other and positioned such that when viewed in cross section, their centers fall on the corners of a square to define first and second diagonally opposite pairs;

b. a fifth warp passing centrally of the four warps in parallel relationship such that its center coincides with the geometric center of said square;

c. a first bobbin thread passing directly about the first diagonally opposite pair without crossing between said pair so that opposite side portions of said fifth warp are held between the first pair; and, d. a second bobbin thread passing directly about the second diagonally opposite pair without crossing between said second pair so that opposite side portions of said fifth warp circumferentially spaced 90° from said first mentioned opposite side portions are held between the second pair so that the outer four warps are bound to said fifth warp without any portion of the first bobbin thread crossing itself and without any portion of the second bobbin thread crossing itself, the parallel warps resulting in minimum elongation of said rope when under tension.

* * * * *